US005863873A

United States Patent [19]

Bovington

[11] Patent Number: 5,863,873

[45] Date of Patent: Jan. 26, 1999

[54] FUEL ECONOMY ADDITIVE AND LUBRICANT COMPOSITION CONTAINING SAME

[75] Inventor: Charles Herbert Bovington, Oxfordshire, United Kingdom

[73] Assignee: Exxon Chemical Patents Inc, Linden, N.J.

[21] Appl. No.: 835,451

[22] Filed: Apr. 8, 1997

[51] Int. Cl.[6] ..... C10M 129/74

[52] U.S. Cl. ..... 508/501; 508/463

[58] Field of Search ..... 508/485, 501, 508/459, 463

[56] References Cited

U.S. PATENT DOCUMENTS

| | | | |
|---|---|---|---|
| 3,620,290 | 11/1971 | Kress et al. | 508/485 |
| 3,850,827 | 11/1974 | Zipf | 508/485 |
| 4,175,046 | 11/1979 | Coant et al. | 508/485 |
| 4,175,047 | 11/1979 | Schick | 508/485 |
| 4,304,678 | 12/1981 | Schick et al. | 508/486 |

*Primary Examiner*—Jacqueline V. Howard
*Attorney, Agent, or Firm*—H. L. Cohen

[57] ABSTRACT

A lubricant composition capable of improving the fuel economy of an internal combustion engine and comprising a base oil as a major component and from about 2 to about 15 wt. %, based on the weight of composition, of a fuel economy improving additive having a viscosity greater than the viscosity of the bulk lubricant and being selected such that the lubricant is characterized by (1) a positive deviation from that of a theoretical line when the elastohydrodynamic (EHD) film thickness thereof is plotted against entrainment speed on a log basis, and by (2) a traction coefficient under both hydrodynamic and mixed lubrication conditions which is lower than it would have been if the fuel economy improving additive were not present in the lubricant is disclosed.

15 Claims, 8 Drawing Sheets

FUEL ECONOMY ADDITIVE AND LUBRICANT COMPOSITION CONTAINING SAME

BACKGROUND OF THE INVENTION

The present invention relates to lubricating oil compositions, and more particularly to crankcase lubricant compositions which contain an effective fuel economy improving additive.

There is an increased requirement for lubricant compositions which are capable of improving the fuel economy of the internal combustion engines in which they are used. An improvement in fuel economy, i.e., a reduction in fuel consumption, generally requires a lowering of frictional losses under a range of lubrication regimes. These regimes are known to those skilled in the art and may be defined in terms of the extent to which lubricant film thicknesses formed in the various points of contact within an engine exceed or fail to exceed the combined roughness of the contact surfaces.

The film thickness depends, in part, on contact geometry, load, elastic properties of metals, lubricant viscosity and the speed with which a lubricant is entrained into the points of contact. Generally speaking, film thickness increases as the viscosity of the lubricant increases and as the speed of sliding and/or rolling motion between the points of contact increases. The increase of the film thickness is not linear, however, and well established equations for predicting film thickness under elastohydrodynamic conditions indicate that the film thickness increases at approximately the same rate as the viscosity to the 0.7 power increases, i.e., viscosity$^{0.7}$, and at approximately the same rate as the speed of sliding and/or rolling contact to the 0.7 power increases, i.e. speed$^{0.7}$. Dowson D. and Higginson G., "Elastohydrodynamic Lubrication", Pergamon Press, Oxford, England, 1977; and Hamrock, B. and Dowson, D., "Ball Bearing Lubrication: the elastohydrodunamics of eliptical contacts", J. Wilet, N.Y., 1981. In accordance with these well established equations, ideal behavior would be characterized by a linear increase in elastohydrodynamic film thickness when plotted against entrainment speed on a log basis, i.e., a straight line (referred to herein as the or a "theoretical line") having a slope of about 0.7.

The lubrication regimes which need to be considered are (1) the hydrodynamic regime, (2) the mixed regime, and (3) the boundary regime. The hydrodynamic regime occurs when the contact surfaces are separated by a lubricant film which is thick by comparison with the roughness of the contact surfaces. This condition occurs when contact pressures are low and/or when speed and/or lubricant viscosity are high. The frictional losses which occur under hydrodynamic conditions are generally proportional to the viscosity of the lubricant at the points of contact. Thus, for increasingly more viscous lubricants, there will be increasingly thicker lubricant films at the contact points, such that there will be a correspondingly lower probability of metal to metal contact and wear. However, as the viscosity of the lubricant increases, there will also be a corresponding increase in frictional losses due to the energy required to shear the thicker lubricant films. When operating under hydrodynamic conditions, frictional coefficients, also known as traction coefficients, typically are on the order of about 0.07 to about 0.03. The lower values are beneficial for fuel economy.

As speeds fall, as contact pressures rise, or as lubricant viscosity falls, the lubricant film thickness generated for a given contact geometry will decrease to the extent that it approaches the dimensions of the surface roughness encountered by the lubricant. Under these conditions the lubricant is operating in the mixed regime and frictional losses are in part due to metal to metal contact and in part due to lubricant shearing friction. Metal to metal contact results in high friction losses and wear, whereas lubricant shearing friction results in lower friction losses. Typically, friction coefficients due to lubricant shearing are on the order of about 0.03, whereas friction coefficients due to metal to metal contact are on the order of from about 0.08 to about 0.30. Thus, as the lubricant film thickness/surface roughness ratio decreases, the contribution to friction loss due to metal to metal contact becomes dominant and the combined friction coefficient (from metal to metal contact and lubricant shear) rapidly increases, typically from about 0.03 to about 0.05–0.15 over a narrow range of lubricant film thickness. In other words, when operating under the mixed lubricant regime, there is a rapid increase in friction losses with a relatively small decrease in lubricant film thickness. Accordingly, any lubricant formulation which enables operation under fluid lubrication to occur down to lower speeds will be beneficial both as to wear and fuel economy. This is especially true if the friction (traction) losses due to the properties of the lubricant are minimized. The difficulty, however, is to get low friction, high viscosity lubricant films into the contact areas when operating at lower speeds.

When speeds are very low, or when lubricant viscosities are very low and/or when contact pressures are very high, the lubricant film thicknesses generated in the contact areas fall to values very much less than the roughness of the contact surfaces. Under these conditions, referred to as the boundary friction regime, the friction losses depend on the properties of surface films formed by physical and/or chemical processes at the contact surfaces. Depending on the properties of the films so formed, the friction coefficients under boundary conditions for contact surfaces lubricated with oil formulations typically are in the range of from about 0.05 to about 0.15. It is known in the art that what are normally referred to as friction modifiers, e.g., glycerol monooleate, are effective for reducing friction losses under boundary lubrication conditions.

The hydrodynamic lubrication regime, the mixed lubrication regime and the boundary lubrication regime occur simultaneously in internal combustion engines at any given time. Depending on the contact geometry, the speeds of sliding and/or rolling contact, the load and the lubricant oil viscosity and temperature, the friction losses can be described in terms of the contribution from the various lubrication regimes, bearing in mind that the contributions will vary for any given lubricant oil as the operating conditions of the engine vary.

One way to illustrate the effects of the various lubricating regimes is to plot the friction coefficient versus the contact speed (or the lubricant film thickness, which is proportional to the contact speed). Such a plot, referred to as a Stribeck traction curve, is useful for comparing the friction losses expected from use of one lubricant formulation over another. A typical Stribeck traction curve (see FIG. 1) will show that the friction coefficient will decrease rapidly with increasing speed (or lubricant film thickness) at very low speeds, and then will level out, and possibly increase slightly, as speeds (or lubricant film thickness) increase. The integrated area under the Stribeck traction curve is a measure of the total friction loss and can be used to project the relative fuel consumption requirements of various lubricant formulations.

There are a number of prior art disclosures relating to the addition of friction modifiers and other additives to lubricating oil compositions with an eye toward reducing friction losses and engine wear. U.S. Pat. No. 2,493,483 to Francis, for example, relates to lubricants for marine steam engines which form oil in water emulsions. The lubricants include "secondary additives" which function to improve performance under certain severe and adverse conditions. The secondary additives comprise esterified polyhydric alcohols, such as glycerol mono- and dioleate, sorbitan mono-, di and trioleate, and pentaerythritol monooleate.

U.S. Pat. No. 2,783,326 to Bondi relates to lubricants usable under extreme operating conditions, e.g., extreme pressure conditions, high speeds, high temperature gear and bearing protection, etc. The lubricants, which are suitable for transmission applications, contain extreme pressure additives and solubilizing agents for the extreme pressure additives. The solubilizing agents may comprise non-ionic esters such as glycerol monooleate, sorbitan monooleate and pentaerythritol monooleate.

U.S. Pat. No. 3,235,498 to Waldmann discloses the use of an ester additive such as glycerol monooleate or sorbitan monooleate to inhibit the foaming tendency that might otherwise occur in lubricating oil formulations which include one or more detergents.

U.S. Pat. No. 3,933,659 to Lyle relates to transmission fluids which contain a number of additives, including fatty esters of dihydric and other polyhydric alcohols, such as pentaerythritol monooleate.

U.S. Pat. No. 4,175,047 to Schick discloses the addition of from 20–40% of a hydroxy-containing ester to a lubricating oil composition as a fuel consumption reducing agent. The improvement in fuel economy is said to be the result of a reduction of viscous friction (which would be beneficial under hydrodynamic conditions). The esters of this patent are derived from acids having a carbon chain length of from about 5 to about 30 carbon atoms and include, for example, glycerol monooleate and sorbitan monooleate. There is no discussion in this patent as to the viscosity of the usable esters, nor of any possible performance advantage under boundary and/or mixed lubrication conditions.

U.S. Pat. No. 4,304,678, also to Schick, relates to the addition of from about 1 to about 4% of a hydroxy-containing ester to a lubricating oil to improve fuel economy. The improvement is said to be the result of reduced friction under boundary lubrication conditions. There is no discussion in this patent as to the possible effects under hydrodynamic or mixed lubrication conditions. The esters disclosed in this patent include glycerol monooleate and sorbitan monooleate.

U.S. Pat. No. 4,336,149 and U.S. Pat. No. 4,376,056, both to Erdman, relate to the addition of from about 0.25 to 2 wt. % of pentaerythritol monooleate to a crankcase lubricating oil to increase the fuel economy. These patents indicate that gains in fuel economy through the use of additives to reduce friction under mixed regime conditions probably will be small and difficult to assess.

U.S. Pat. No. 4,734,211 to Kennedy relates to lubricating oil compositions for use with railway diesel engines, which typically have silver plated bearings. The lubricant compositions include base oil, a dispersant, at least one overbased detergent, and a polyhydroxy compound such as glycerol monooleate or pentaerythritol trioleate to inhibit silver wear.

U.S. Pat. No. 5,064,546 to Dasai relates to lubricating oils which reduce friction in transmission, wet clutch and shock absorber applications. The lubricating oils contain a specific base oil and a friction modifier such as a fatty acid ester of sorbitan, pentaerythritol, trimethylol propane, or the like.

U.S. Pat. No. 4,683,069 to Brewster relates to lubricating oil compositions which exhibit improved fuel economy and which contain from about 0.05 to 2 wt. % of a glycerol partial ester of a $C_{16}$–$C_{18}$ fatty acid.

U.S. Pat. No. 4,105,571, U.S. Pat. No. 4,459,223 and U.S. Pat. No. 4,617,134, all to Shaub, relate to lubricating oil compositions having improved friction reducing and anti-wear properties. The '571 patent discloses a composition comprising a base oil and a predispersion of a glycol ester and/or a zinc dihydrocarbyl dithiophospahte with an ashless dispersant to improve package stability. The '223 patent discloses the use of up to about 2 wt. % of an ester additive, which is derived from dimer carboxylic acids and polyhydric alcohols having at least three hydroxy groups, to reduce boundary friction. The '134 patent discloses the use of less than 2 wt. % of an ester of a polycarboxylic acid with a glycol or glycerol, plus an ashless dispersant and a zinc dihydrocarbyl dithiophosphate to reduce boundary friction.

U.S. Pat. No. 4,167,486 to Rowe relates to lubricating oils containing olefin polymerizable acid esters and dimers and/or trimers thereof as fuel economy improving additives. The esters disclosed in this patent contain at least two double bonds paired in one of the following configurations: —C═C—C—C═C— or —C═C—C═C—. The esters disclosed in this patent and are distinguishable from esters of oleic acid, for example, which have only one double bond, i.e., —C═C—, per alkyl chain length.

U.S. Pat. No. 4,440,660 to Van Rijs describes low viscosity esters for use in lubricating oils. The esters typically would have a viscosity lower than the viscosity of the base oil.

U.S. Pat. No. 4,154,473 to Coupland discloses the use of molybdenum complexes to reduce friction. This patent mentions reduction of friction losses by use of synthetic ester oils, but there are no details given as to the which esters might be used, as to the viscosity of the esters, nor as to the their contemplated treat rates.

In spite of the many advances in lubricant oil formulation technology, there remains a need for lubricant oil compositions that offer improved fuel economy.

SUMMARY OF THE INVENTION

It is an object of the present invention to provide a lubricant oil composition which is capable of improving the fuel economy of an internal combustion engine in which the lubricant is used.

It is a further object to provide a fuel consumption improving additive which can be mixed with a base oil of lubricating viscosity to provide a crankcase lubricant which is characterized by improved friction performance under boundary lubrication, mixed lubrication and hydrodynamic lubrication conditions.

Yet another object is to provide an economical and convenient method of improving fuel consumption performance of an internal combustion engine.

Still another object is to provide a lubricant formulator with facile means for balancing fuel economy and wear protection in low viscosity lubricating oils of the types which will be required to meet current and future specifications.

These and other objects and advantages of the present invention are achieved by adding to a base oil of lubricating viscosity a fuel economy improving additive comprised of a polar compound having a viscosity higher than the viscosity of the base oil and being characterized in that the polar compound, when added to the base oil, (1) will cause the resulting mixture to have a positive deviation from that of a Newtonian fluid when the elastohydrodynamic (EHD) film thickness of the mixture is plotted against the entrainment speed on a log basis, and (2) will reduce the friction coefficient (also known as the traction coefficient) of the mixture relative to the friction coefficient of the base oil.

In one aspect of the invention, the fuel economy improving additive, which is present in the lubricant composition in an amount of from about 2 to about 50 wt. %, typically from about 5 to about 15 wt. %, based on the weight of the fully formulated lubricant composition, comprises an ester, such as sorbitan monooleate, sorbitan trioleate or pentaerythritol dioleate.

BRIEF DESCRIPTION OF THE DRAWINGS

The invention will be more fully appreciated in view of the following detailed description, especially when considered in conjunction with the drawings, wherein.

DETAILED DESCRIPTION

Figure 1:
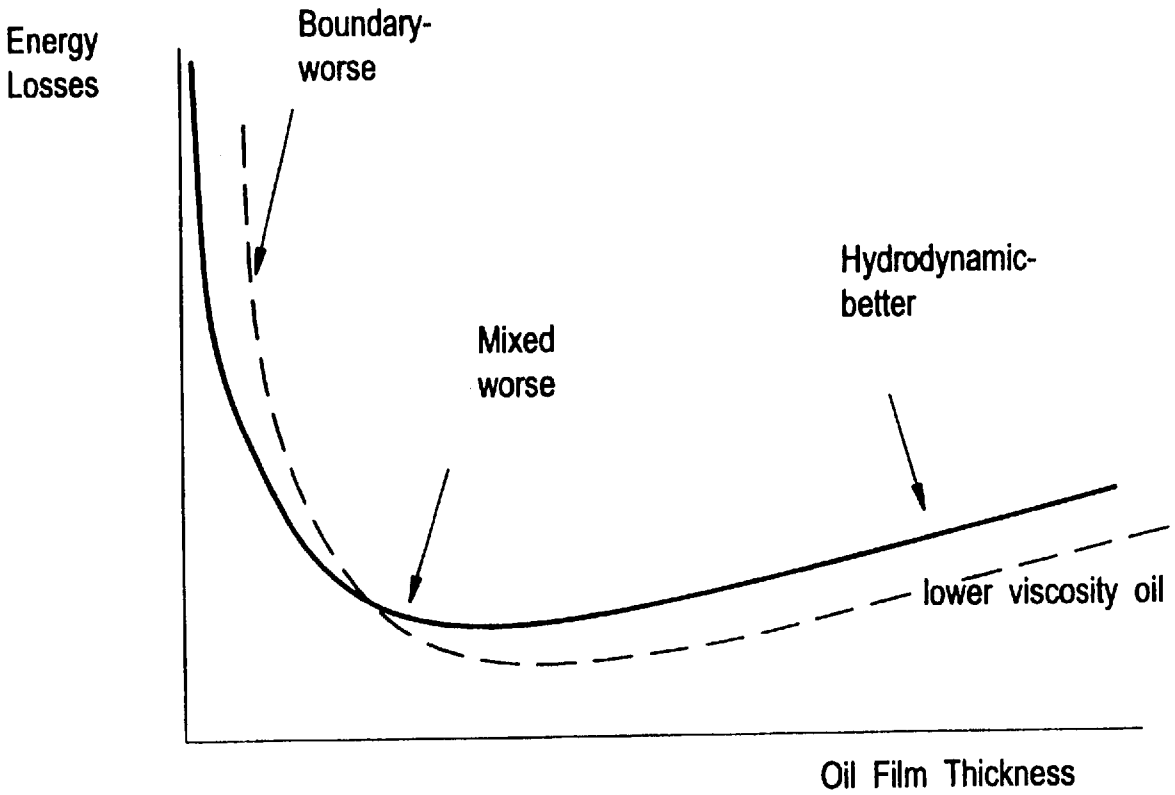
FIG. 1 is a schematic graph illustrating energy losses versus lubricant oil film thickness for conventional lubricant oil compositions which differ only in viscosity.

The present invention relates to crankcase lubricant compositions which are prepared by adding to a base oil of lubricating viscosity a fuel economy improving additive comprised of a polar compound having a viscosity higher than the viscosity of the base oil and being characterized in that the polar compound, when added to the base oil, (1) will cause the resulting admixture to have a positive deviation from that of a Newtonian fluid when the elastohydrodynamic (EHD) film thickness of the admixture is plotted against the entrainment speed on a log basis, and (2) will reduce the friction coefficient (also known as the traction coefficient) of the admixture relative to the friction coefficient of the base oil.

The base oil of lubricating viscosity comprises the major component of the lubricating oil compositions of the present invention and typically is present in an amount ranging from about 50 to about 98 wt. %, e.g., from about 85 to about 95 wt. %, based on the total weight of the composition. The base oil may be selected from any of the synthetic or natural oils typically used as crankcase lubricating oils for spark-ignited and compression-ignited engines. The base oil conveniently has a viscosity of about 2.5 to about 12 cSt or $mm^2/s$ and preferably about 2.5 to about 9 cSt or $mm^2/s$ at 100° C. Mixtures of synthetic and natural base oils may be used if desired.

In addition to the base oil of lubricating viscosity, the present lubricating oil compositions contain, as an essential component, a minor amount of a fuel economy improving agent. The fuel economy improving additive comprises any polar compound which has a viscosity greater than the viscosity than the base oil, and which is capable of causing the mixture of the base oil and fuel economy improving additive to be characterized by (1) a positive deviation from that of a Newtonian fluid when the elastohydrodynamic (EHD) film thickness of the admixture is plotted against the entrainment speed on a log basis, and by (2) a reduction in the traction coefficient of the mixture, as compared to the traction coefficient of the lubricant composition without the presence of the fuel economy improving additive.

Polar materials having a viscosity higher than that of the bulk oil at a given temperature, and having a traction coefficient lower than that of the bulk oil, would be expected to reduce friction under boundary lubrication conditions. However, it has now been found, totally unexpectedly, that such polar materials also can be used to reduce friction losses under mixed lubrication conditions and under hydrodynamic lubrication conditions. This discovery is a basis of the present invention and provides a lubricant formulator with a powerful tool for balancing fuel economy and wear protection in low viscosity lubricant oils.

In one aspect of the invention, the fuel economy improving additive may comprise one or a mixture of full or partial esters of polyhydric alcohols and unsaturated, aliphatic carboxylic acids having from about 9 to about 36, and preferably about 10 to about 20, e.g., 12 to 20, carbon atoms in the carbon chain. The esters must have a viscosity which is greater than the viscosity of the base oil in order to be suitable for use in the present invention. The esters also must be capable of causing the lubricant composition to which they are added to exhibit a positive deviation from that of a Newtonian fluid when the elastohydrodynamic (EHD) film thickness of the lubricant composition is plotted against the entrainment speed on a log basis. The esters also must cause a reduction in the traction coefficient of the lubricant composition, as compared to the traction coefficient of the lubricant composition without the presence of the ester fuel economy improving additive.

Suitable ester fuel economy improving additives include, for example, esters of oleic acid and polyhydric alcohols such as sorbitol, sorbitan, pentaerythritol, trimethylol propane or the like; esters of linoleic acid and polyhydric alcohols such as sorbitol, sorbitan, pentaerythritol, trimethylol propane or the like; esters of linolic acid and polyhydric alcohols such as sorbitol, sorbitan, pentaerythritol, trimethylol propane or the like, and mixtures of such esters. Particularly suitable esters include, for example, sorbitan monooleate, pentaerythritol dioleate and sorbitan trioleate.

Certain esters of glycerol, such as glycerol monooleate, are not suitable for use in the present invention. When added to a base oil in the amounts contemplated herein, glycerol monooleate tends to form soapy deposits which can foul engine components. Also, depending on how much glycerol monooleate is added, the resulting mixture may exhibit a neutral or even a negative deviation relative to the theoretical line. The addition of certain esters of pentaerythritol, such as pentaerythritol monooleate, also cause the resulting lubricant compositions to exhibit a neutral or negative deviation from that of the theoretical line. Accordingly, pentaerythritol monooleate, like other esters that result in a neutral or negative deviation relative to the theoretical line, would not be among the fuel economy improving additives contemplated for use in the present invention.

The amount of fuel economy improving additive that is required to be admixed with the base oil to be effective varies over wide limits. However, it has been found that a minimum of about 2 wt. % of fuel economy improving additive, based on the weight of the finished lubricant composition, should be added. Typically, the fuel economy improving additive will be added in amounts ranging from about 2 to about 50 wt. %, e.g., about 5 to about 15 wt. %. In preferred aspects of the invention, from about 4 to about 25, and more preferably from about 5 to about 15 wt. %, of the additive will be present in the final lubricant composition.

ADDITIONAL COMPONENTS

In addition to the base lubricating oil and the fuel economy improving additive, which are essential components, the lubricating oil compositions of the present invention typically contain one or more or optional components, such as ashless nitrogen containing dispersants, ashless nitrogen containing dispersant-viscosity modifiers, antiwear and antioxidant agents, supplemental dispersants, supplemental friction modifiers, rust inhibitors, anti-foaming agents, demulsifiers, pour point depressants, and the like.

In general, suitable ashless nitrogen containing dispersants comprises an oil solubilizing polymeric hydrocarbon backbone derivatized with nitrogen substituents that are capable of associating with polar particles to be dispersed. Typically, the dispersants comprise a nitrogen containing moiety attached to the polymer backbone, often via a bridging group, and may be selected from any of the well known oil soluble salts, amides, imides, amino-esters, and oxazolines of long chain hydrocarbon substitued mono- and dicarboxylic acids or their anhydrides; thiocarboxylate derivatives of long chain hydrocarbons; long chain aliphatic hydrocarbons having a polyamine attached directly thereto; and Mannich condensation products formed by condensing a long chain substitued phenol with formaldehyde and polyalkylene polyamine.

The oil soluble polymeric hydrocarbon backbone is typically an olefin polymer, especially polymers comprising a major molar amount (i.e. greater than 50 mole %) of a $C_2$ to $C_{18}$ olefin (e.g., ethylene, propylene, butylene, isobutylene, pentene, octene-1, styrene), and typically a $C_2$ to $C_5$ olefin. The oil soluble polymeric hydrocarbon backbone may be a homopolymer (e.g. polypropylene or polyisobutylene) or a copolymer of two or more of such olefins (e.g. copolymers of ethylene and an alpha-olefin such as propylene and butylene or copolymers of two different alpha-olefins). Other copolymers include those in which a minor molar amount of the copolymer monomers, e.g., 1 to 10 mole %, is a $C_3$ to $C_{22}$ non-conjugated diolefin (e.g., a copolymer of isobutylene and butadiene, or a copolymer of ethylene, propylene and 1,4-hexadiene or 5-ethylidene-2-norbomene).

Preferred olefin polymers include polybutenes and specifically polyisobutenes (PIB) or poly-n-butenes, such as may be prepared by polymerization of a $C_4$ refinery stream.

Suitable olefin polymers and copolymers may be prepared by cationic polymerization of hydrocarbon feedstreams, usually $C_3$–$C_5$, in the presence of a strong Lewis acid catalyst and a reaction promoter, usually an organoaluminum such as HCl or ethylaluminum dichloride. Tubular or stirred reactors may be used. Such polymerizations and catalysts are described, e.g., in U.S. Pat. No. 4,935,576. Fixed bed catalyst systems also may be used as disclosed, e.g., in U.S. Pat. No. 4,982,045. Most commonly, polyisobutylene polymers are derived from Raffinate I refinery feedstreams. Conventional Ziegler-Natta polymerization also may be employed to provide olefin polymers suitable for preparing dispersants and other additives.

The oil soluble polymeric hydrocarbon backbone usually will have a number average molecular weight (Mn) within the range of from about 300 to about 10,000. The Mn of the backbone is preferably within the range of 500 to 10,000, more preferably 700 to 5,000 where the use of the backbone is to prepare a component having the primary function of dispersancy. Particularly useful olefin polymers for use in preparing dispersants have a Mn within the range of from 1500 to 3000. Where the component is also intended to have a viscosity modification effect it is desirable to use higher molecular weight polymers, typically polymers having a Mn of from about 2,000 to about 20,000; and if the component is intended to function primarily as a viscosity modifier, polymers having a Mn of from 20,000 to 500,00 or greater should be used. The functionalized olefin polymers used to prepare dispersants preferably have approximately one terminal double bond per polymer chain.

The Mn for such polymers can be determined by several known techniques. A convenient method for such determination is by gel permeation chromatography (GPC) which additionally provides molecular weight distribution information, see W. W. Yau, J. J. Kirkland and D. D. Bly, "Modern Size Exclusion Liquid Chromatography", John Wiley and Sons, New York, 1979.

The oil soluble polymeric hydrocarbon backbone may be functionalized to incorporate a functional group into the backbone of the polymer, or as pendant groups from the polymer backbone. The functional group typically will be polar and contain one or more hetero atoms such as P,O,S,N, halogen, or boron. The functional group can be attached to a saturated hydrocarbon backbone via substitution reactions or to an olefinic portion via addition or cycloaddition reactions. Alternatively, the functional group can be incorporated into the polymer by oxidation or cleavage of a small portion of the end of the polymer (e.g., as in ozonolysis).

Useful functionalization reactions include, for example, halogenation of the polymer at an olefinic bond and subsequent reaction of the halogenated polymer with an ethylenically unsaturated functional compound; reaction of the polymer with an unsaturated functional compound by the "ene" reaction absent halogenation (e.g., maleation where the polymer is reacted with maleic acid or anhydride); reaction of the polymer with at least one phenol group (this permits derivatization in a Mannich Base-type condensation); reaction of the polymer at a point of unsaturation with carbon monoxide using a Koch-type reaction to introduce a carbonyl group in an iso or neo position; reaction of the polymer with the functionalizing compound by free radical addition using a free radical catalyst; reaction with a thiocarboxylic acid derivative; and reaction of the polymer by air oxidation methods, epoxidation, chloroamination, or ozonolysis.

The functionalized oil soluble polymeric hydrocarbon backbone is then further derivatized with a nucleophilic amine, amino-alcohol, or mixture thereof to form oil soluble salts, amides, imides, amino-esters, an oxazolines. Useful amine compounds include mono- and (preferably) polyamines, most preferably polyalkylene polyamines, of abut 2 to 60, preferably 2 to 40 (e.g. 3 to 20), total carbon atoms and about 1 to 12, preferably 3 to 12, and most preferably 3 to 9 nitrogen atoms in the molecule. These amines may be hydrocarbyl amines or may be predominantly hydrocarbyl amines in which the hydrocarbyl group includes other groups, and the like. Preferred amines are aliphatic saturated amines. Non-limiting examples of suitable amine compounds include: 1,2-diaminoethane; polyethylene amines such as diethylene triamine and tetraethylene pentamine; and polypropyleneamines such as 1,2-propylene diamine.

Other useful amine compounds include, for example, alicyclic diamines such as 1,4-di(aminomethyl) cyclohexane; heterocyclic nitrogen compounds such as imidazolines; polyoxyalkylene polyamines; polyamido and related amido-amines; and tris(hydroxymethyl)amino methane (THAM). Dendrimers, star-like amines, and comb-structure amines also may be used, as may mixtures of amine compounds such as those prepared by reaction of alkylene dihalides with ammonia.

A preferred group of nitrogen containing ashless dispersants includes those derived from polyisobutylene substituted with succinic anhydride groups and reacted with polyethylene amines (e.g., tetraethylene pentamine) or with aminoalcohols and, optionally, with additional reactants such as alcohols.

The nitrogen containing dispersant can be further post-treated by a variety of conventional post treatments such as boration as generally taught in U.S. Pat. Nos. 3,087,936 and 3,254,025. This is readily accomplished by treating an acyl nitrogen dispersant with a boron compound selected from the group consisting of boron oxide, boron halides, boron acids and esters of boron acids in an amount to provide from about 0.1 atomic proportion of boron for each atomic proportion of nitrogen of the acylated nitrogen composition to about 20 atomic proportions of boron for each atomic proportion of nitrogen of the acylated nitrogen composition.

Boration is readily carried out by adding from about 0.05 to 4, e.g. 1 to 3 wt. % (based on the weight of acyl nitrogen compound) of a boron compound, preferably boric acid, which is usually added as a slurry to the acyl nitrogen compound and heating with stirring at from about 135° C. to 190° C., e.g., 140°–170° C., for from 1 to 5 hours followed by nitrogen stripping.

Suitable viscosity modifiers (or viscosity index improvers) that may be added to the present lubricting oil compositions include oil soluble polymers having a weight average molecular weight of from about 10,000 to 1,000,000, preferably 20,000 to 500,000, as determined by gel permeation chromatography or light scattering methods.

Representative examples of such polymers include polyisobutylene, copolymers of ethylene and propylene and higher alpha-olefins, polymethacrylates, methacrylate copolymers, polyalkylmethacrylates, copolymers of styrene and acrylic esters, copolymers of a vinyl compound and an unsaturated dicarboxylic acid, and partially hydrogenated copolymers of styrene/isoprene, styrene/butadiene, and isoprene/butadiene, as well as the partially hydrogenated homopolymers of butadiene and isoprene and copolymers of isoprene/divinylbenzene.

Viscosity modifiers that function as dispersant-viscosity modifiers also may be used. Descriptions of how to make such dispersant-viscosity modifiers are found, for example, in U.S. Pat. Nos. 4,089,794, 4,160,739, and 4,137,185. Other dispersant-viscosity modifiers are copolymers of ethylene or propylene reacted or grafted with nitrogen compounds such as described in U.S. Pat. Nos. 4,068,056, 4,068,058, 4,146,489 and 4,149,984.

Antiwear and antioxidant agents which may be incorporated in the lubricating oil compositions include, for example, dihydrocarbyl dithiophosphate metal salts, wherein the metal may be an alkali or alkaline earth metal, or zinc, aluminum, lead, tin, molybdenum, manganese, nickel or copper. The zinc salts are most commonly used in lubricating oil compositions in amounts of from about 0.1 to about 10, preferably about 0.2 to about 2 wt. %, based upon the total weight of the lubricating oil composition. The salts may be prepared in accordance with known techniques by first forming a dihydrocarbyl dithiophosphoric acid (DDPA), usually by reaction of one or more alcohols or a phenol with $P_2S_5$ and then neutralizing the formed DDPA with a zinc compound. The zinc dihydrocarbyl dithiophosphates can be made from mixed DDPA which in turn may be made from mixed alcohols. Alternatively, multiple zinc dihydrocarbyl dithiophosphates can be made and subsequently mixed.

Preferred zinc dihydrocarbyl dithiophosphates useful in the present invention are oil soluble salts of dihydrocarbyl dithiophosphoric acids wherein the hydrocarbyl moieties may be the same or different hydrocarbyl radicals containing from 1 to 18, preferably 2 to 12, carbon atoms and may comprise radicals such as alkyl, alkenyl, aryl, aralkyl, alkaryl and cycloaliphatic radicals. Particularly preferred hydrocarbyl radicals are alkyl groups of 2 to 8 carbon atoms, including, for example ethyl, n-propyl, n-butyl, i-butyl, amyl, n-hexyl, n-octyl, and 2-ethylhexyl. In order to obtain oil solubility, the total number of carbon atoms in the dithiophosphoric acid generally will be about 5 or greater.

Supplemental dispersants, i.e. dispersants that do not contain nitrogen may be used. These nitrogen free dispersants may be esters made by reactiong any of the functionalized oil soluble polymeric hydrocarbon backbones described above with hydroxy compounds such as monohydric and polyhydric alcohols or with aromatic compounds such as phenols and naphthols. The polyhydric alcohols are preferred, e.g. ethylene glycol, and other alkylene glycols in which the alkylene radical contains from 2 to about 8 carbon atoms. Other useful polyhyric alcohols include glycerol, monostearate of glyerol, pentaerythritol, dipentaerythritol, and mixtures thereof.

The ester dispersants also may be derived from unsaturated alcohols such as allyl alcohol. Still other classes of the alcohols capable of yielding nitrogen free ashless dispersants comprise ether-alcohols including, for example, oxyalkylene and oxy-arylene-ether alcohols. They are exemplified by ether-alcohols having up to about 150 oxy-alkylene radicals in which the alkylene radical contains from 1 to 8 carbon atoms.

The ester dispersants may be prepared by one of several known methods as illustrated for example in U.S. Pat. No.

3,381,022. The ester dispersants also may be borated, similar to the nitrogen containing dispersants, as described above.

Oxidation inhibitors also may be included in the lubricating oil compositions. Oxidation inhibitors reduce the tendencey of mineral oils to deteriorate in service, which deterioration can be evidenced by the products of oxidation such as sludge and varnish-like deposits on engine surfaces and by viscosity growth. Such oxidation inhibitors include hindered phenols, alkaline earth metal salts of alkylphenolthioesters having preferably $C_5$ to $C_{12}$ alkyl side chains, calcium nonylphenol sulfide, ashless oil soluble phenates and sulfurized phenates, phosphosulfurized or sulfurized hydrocarbons, metal thiocarbamates, oil soluble copper compounds such as those described in U.S. Pat. No. 4,867,890, and molybdenum containing compounds such as molybdenum octoate (2-ethyl hexanoate), molybdenum dithiocarbamates, molybdenum dithiophosphates, oil-soluble molybdenum xanthates and thioxanthates, and oil-soluble molybdenum- and sulfur-containing complexes.

In one aspect of the invention the lubricating oil composition includes a sulfurized alkyl phenol or hindered phenol antioxidant. Generally, hindered phenols are oil soluble phenols substituted at one or both ortho positions. Additional antioxidants which may be used in the present compositions are disclosed in U.S. Pat. No. 5,232,614.

Supplemental friction modifiers may be included in the lubricating oil compositions to further reduce engine wear and/or to further improve fuel economy. Examples of other such friction modifiers are described by M. Belzer in the "Journal of Tribology" (1992), Vol. 114, pp. 675–682 and M. Belzer in the "Journal of Tribology" (1992), Vol. 114, pp. 675–682 and M. Belzer and S. Jahanmir in "Lubrication Science" (1988), Vol. 1, pp. 3–26.

Rust inhibitors selected from the group consisting of nonionic polyoxyalkylene polyols and esters thereof, polyoxyalkylene phenols, and anionic alkyl sulfonic acids may be used in the present lubricating oil compositions.

Copper and lead bearing corrosion inhibitors may be used, but are typically not required with the compositions of the present invention. Typically such compounds are the thiadiazole polysulfides containing from 5 to 50 carbon atoms, their derivatives and polymers thereof. Derivatives of 1,3,4 thiadiazoles such as those described in U.S. Pat. Nos. 2,719,126, and 3,087,932 are typical. Other suitable corrosion inhibiting materials are disclosed in U.S. Pat. No. 5,232,614. When these compounds are included in the lubricating composition, they are preferably present in an amount not exceeding 0.2 wt. % active ingredient.

Foam control can be provided by many compounds including an anitfoamant of the polysiloxane type, for example, silicone oil or polydimethyl siloxane.

A small amount of a demulsifying component may be used. A preferred demulsifying component can be obtained by reacting an alkylene oxide with an adduct obtained by reacting a bis-epoxide with a polyhydric alcohol (see, EP 330,522). The demulsifier should be used at a level not exceeding 0.1 mass % active ingredient. A treat rate of 0.001 to 0.05 mass % active ingredient is convenient.

Pour point depressants, otherwise known as lube oil flow improvers, lower the minimum temperature at which the fluid will flow or can be poured. Such additives are well known. Typical of those additives which improve the low temperature fluidity of lubricating oil compositions are $C_8$ to $C_{18}$ dialkyl fumarate/vinyl acetate copolymers and polyalkylmethacrylates.

Some of the above-mentioned additives can provide a multiplicity of effects. For example, a single additive may act as a dispersant-oxidation inhibitor. This approach to lubricating oil formulating is well known and does not require further elaboration.

The various components may be incorporated into a base oil in any convenient way. For example, each of the components can be added directly to the oil by dispersing or dissolving it in the oil at the desired level of concentration. Such blending may occur at ambient temperature or at an elevated temperature.

Preferably all the additives except for the viscosity modifier and the pour point depressant are blended into a concentrate that is subsequently blended into basestock to make finished lubricant compositions. Use of such concentrates is conventional. The concentrate typically will be formulated to contain the additive(s) in proper amounts to provide the desired concentration in the final formulation when the concentrate is combined with predetermined amount of base lubricating oil.

Preferably the concentrate is made in accordance with the method described in U.S. Pat. No. 4,938,880. That patent describes making a premix of ashless dispersant and metal detergents that is pre-blended at a temperature of at least about 100° C. Thereafter the pre-mix is cooled to at least 85° C and the additional components are added. Such a concentrate advantageously comprises the following additives:

| ADDITIVE | Wt. % (Broad) | Wt. % (Preferred) |
|---|---|---|
| Nitrogen containing Ashless Dispersant(s) | 20–40 | 25–35 |
| Metal detergents | 0–6 | 1–4 |
| Corrosion Inhibitor | 0–0.02 | 0–0.01 |
| Metal Dithiophosphate | 4–10 | 5–8 |
| Supplemental anti-oxidant | 0–6 | 0–4 |
| Anti-Foaming Agent | 0.001–0.1 | 0.001–0.05 |
| Supplemental Anti-wear Agents | 0–4 | 0–2 |
| Supplemental Friction Modifiers | 0–4 | 0–2 |
| Mineral or synthetic base oil | balance | balance |

The final formulations may employ from 3 to 15 wt. % and preferably 4 to 20 wt. %, typically about 5 to 15 wt. % of the additive package(s) with the remainder being base oil. A preferred concentrate contains at least one ashless nitrogen containing dispersant, at least one overbased metal detergent, and at least one ester fuel economy improving additive.

With reference to FIG. 1, it can be seen that energy losses that occur during the operation of a lubricated internal combustion engine vary with respect to the thickness of the lubricant film on the contact surfaces. More important, however, it can be seen that energy losses are significantly higher when the engine is operating under boundary lubrication conditions, i.e., when the lubricant film thickness is very small (typically in the sub 20 nm. range), than when the engine is running under mixed lubrication conditions or hydrodynamic lubrication conditions. FIG. 1 also illustrates that when the viscosity of a lubricant composition is lowered, without changing any of the other properties of the lubricant(the dashed curve in FIG. 1), the energy losses in the hydrodynamic region are lowered, but the energy losses increase at a greater rate in the mixed and boundary regions. This would be expected because, when operating under hydrodynamic lubrication conditions, frictional losses are proportional to the viscosity of the lubricant in the areas of contact; but when operating with lubricants having a very low viscosity, there is a much higher probability of metal to metal contact in the sub-20 nm. region, when using the apparatus described in Example 1 herein, because lubricant film thickness generated at the contact surfaces falls to values less than the roughness of the contact surfaces more easily with lower viscosity lubricants than with higher viscosity lubricants.

Figure 2:
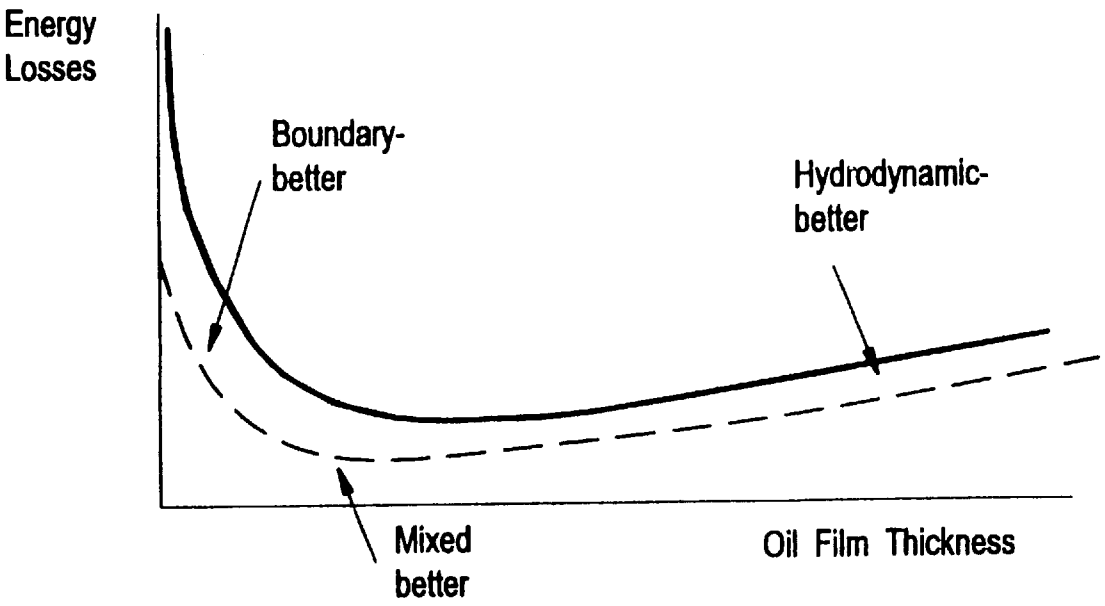
FIG. 2 is a schematic graph, similar to FIG. 1, illustrating energy losses versus lubricant oil film thickness for a conventional lubricant oil composition and for an "optimized" lubricant composition.

An "optimized" lubricant would be one that results in reduced friction energy losses regardless of film thickness, i.e., regardless of whether an engine is operating under boundary, mixed or hydrodynamic lubrication conditions. This scenario is illustrated in FIG. 2, wherein the solid curve represents the results achieved by a conventional lubricant and the dashed curve represents the results achieved by an "optimized" lubricant.

By adding the fuel economy improving additives of the present invention to an otherwise conventional lubricating oil, a formulator can prepare "optimized" lubricant compositions. This is because the EHD film thickness formed in the very thin film (<10 nm.) region is controlled by the viscosity of the polar fuel economy improving additive, rather than by the viscosity than the fully formulated lubricant. This means that a mixture of a highly viscous fuel economy improving additive, such as pentaerythritol diooleate, in a less viscous base oil, such as a poly(alpha-olefin) having a viscosity of about 6 cSt., will result in thicker than predicted lubricant films in the sub-20 nm. region. This phenomenon can be ascribed to the fractionation of the lubricant mixtures close to the contact surfaces due to lubricant molecule/surface van der Waals forces. Moreover, since the present fuel economy improving additives are chosen not only because they are polar and more viscous than the bulk lubricant composition, but because they also lower the composition's friction (traction) coefficient, there will be a reduced energy (friction) loss when the lubricant film thickness increases (above about 20 nm.) and the engine is operating under mixed and/or hydrodynamic lubrication conditions.

Figure 3:
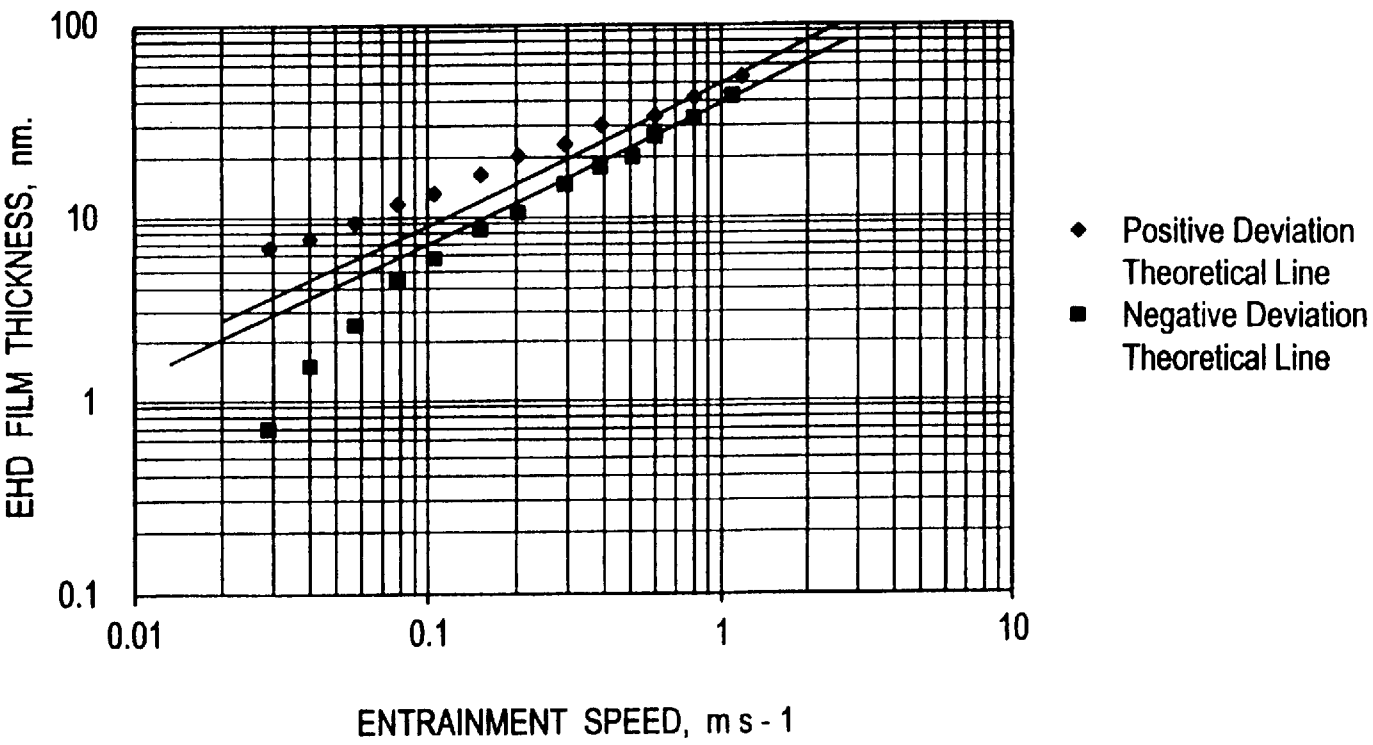
FIG. 3 is a schematic graph illustrating the elastohydrodynamic (EHD) film thickness versus entrainment speed on a log basis of a lubricant characterized by a negative deviation relative to a theoretical line, of a theoretical line, and of a lubricant composition in accordance with the present invention, which is characterized by a positive deviation relative to a theoretical line.

FIG. 3 illustrates one of the criteria that must be met for the present lubricant compositions, i.e., that they must be characterized by a positive deviation relative to the theoretical line that would represent ideal behavior when the elastohydrodynamic (EHD) film thickness (in nm.) of the lubricant is plotted against the entrainment speed (in $ms^{-1}$) of the lubricant at the areas of contact on a log basis. For purposes of illustration, the solid line (at a slope of approximately 0.7) represents the curve that would be exhibited by a fluid which follows the theoretical line. The curve represented by the filled squares illustrates a positive deviation relative to the Newtonian fluid, and the curve represented by the filled triangles illustrates a negative deviation relative to the theoretical line. A curve (not shown) which essentially follows the theoretical line would be described as being neutral.

The invention is further described, by way of illustration only, in the following examples, wherein all parts and percentages are by weight unless noted otherwise.

EXAMPLE 1

Elastohydrodynamic (EHD) film thicknesses and friction (traction) coefficients were measured for a series of binary mixtures of ester fuel economy improving additive in 6 cSt. poly(alpha-olefin) (PAO) base oil or in Exxon solvent neutral 90 (ESN) base oil, as indicated in Table 1. The measurements were made on a Traction and optical EHD film thickness rig. The test rig used a reflective steel ball and a glass disc contact surface, and measured the EHD by ultrathin film interferometry. A high pressure contact was established between the steel ball and the flat surface of the glass disc, which was coated with a thin, semi-reflective layer of chromium. A silica spacer layer (about 500 nm thick) was coated over the chromium layer. White light was shown on the contact surface. Some of the light was reflected from the chromium layer, while some of the light passed through the chromium layer and any lubricant film present and was reflected from the steel ball. The two reflected beams of light recombined and interfered. (The silica layer functioned as a spacing layer which ensured that interference would occur even if no oil film were present). The interfered light from a strip across the contact was passed into a spectrometer where it was dispersed and detected by a solid state, black and white TV camera. A frame grabber was used to capture this image and a microcomputer program was used to determine the wavelength of maximum constructive interference in the central region of the contact. The lubricant film thickness was then calculated from the difference between the measured film thickness and the thickness of the silica spacer layer at that position. This technique was able to measure film thicknesses down to 10 nm with an accuracy of ±5% and below this down to 1±0.5 nm. During the test, the ball was loaded against the glass disc, and both the ball and the disc were held in a temperature-controlled, stainless steel chamber. The ball was rolled across the glass disc. In the traction mode the ball is in contact with a steel disc. The speed of the ball and the disc may be varied. The contact can be described as a variable ratio of sliding to rolling, (Slide/Roll ratio). Traction coefficients are a measure of the friction losses under sliding and/or rolling contacts. Two types of measurements are made, namely: traction coefficient as a function of Slide/Roll ration, and traction coefficient as a function of entrainment speed (Stribeck Traction).

For each mixture, the friction (traction) coefficient was measured as a function of slide/roll ratio at 40°, 60°, 80°, 100° and 135° C., the traction coefficient was measured as a function of entrainment speed at 80°, 100° and 135° C., and the EHD film thickness was measured as a function of entrainment speed. Viscometric data for each mixture, and for 3% and 15% binary mixtures of 6 cSt. PAO and ESN 90 are set forth in Table 1. In Table 1, sorbitan monooleate is abbreviated as SMO, pentaerythritol dioleate is abbreviated as PDO, and sorbitan triooleate is abbreviated as STO. The integrated value of the area under the Stribeck curve at 135° C. (referred to as the Stribsum) and the limiting traction coeficients (TRAC 40, TRAC 60, etc.) are set forth in Table 2.

TABLE 1

| Binary Mixture | Kv 40, cSt. | Kv 100, cSt. |
|---|---|---|
| 10% SMO in ESN 90 | 21.50 | 4.27 |
| 10% PDO in ESN 90 | 20.91 | 4.19 |
| 10% STO in ESN 90 | 20.80 | 4.21 |
| 10% SMO in 6 cSt. PAO | 35.26 | 6.40 |
| 10% PDO in 6 cSt. PAO | 33.95 | 6.23 |
| 10% STO in 6 cSt. PAO | 33.66 | 6.24 |
| 2% SMO in ESN 90 | 18.63 | 3.84 |
| 2% PDO in ESN 90 | 18.53 | 3.85 |
| 2% STO in ESN 90 | 18.55 | 3.85 |
| 2% SMO in 6 cSt. PAO | 31.55 | 5.92 |
| 2% PDO in 6 cSt. PAO | 31.32 | 5.86 |
| 2% STO in 6 cSt. PAO | 31.33 | 5.92 |
| 3% 6 cSt. PAO in ESN 90 | 18.65 | 3.93 |
| 15% 6 cSt. PAO in /ESN 90 | 20.16 | 4.17 |

TABLE 2

| | Stribsum | Trac 40 | Trac 60 | Trac 80 | Trac 100 | Trac 135 |
|---|---|---|---|---|---|---|
| 10% SMO in ESN90 | 4.13E-01 | 4.81E-02 | 3.96E-02 | 3.29E-02 | 2.55E-02 | 1.70E-02 |
| 10% PDO in ESN90 | 4.57E-01 | 4.85E-02 | 4.02E-02 | 3.26E-02 | 2.59E-02 | 1.74E-02 |
| 10% STO in ESN90 | 4.83E-01 | 4.76E-02 | 4.11E-02 | 3.35E-02 | 2.57E-02 | 1.79E-02 |
| 10% SMO in 6 cSt. PAO | 3.14E-01 | 3.37E-02 | 2.65E-02 | 2.11E-02 | 1.59E-02 | 1.05E-02 |
| 10% PDO in 6 cSt. PAO | 2.94E-01 | 3.29E-02 | 2.71E-02 | 2.11E-02 | 1.61E-02 | 9.63E-02 |
| 10% STO in 6 cSt. PAO | 3.03E-01 | 3.38E-02 | 2.66E-02 | 2.15E-02 | 1.67E-02 | 1.14E-02 |
| 2% SMO in ESN90 | 6.72E-01 | 5.21E-02 | 4.50E-02 | 3.81E-02 | 3.28E-02 | 2.65E-02 |
| 2% PDO in ESN90 | 4.90E-01 | 5.07E-02 | 4.38E-02 | 3.56E-02 | 2.80E-02 | 1.86E-02 |
| 2% STO in ESN90 | 5.21E-01 | 5.17E-02 | 4.26E-02 | 3.55E-02 | 2.73E-02 | 2.01E-02 |
| 2% SMO in 6 cSt. PAO | 3.59E-01 | 3.42E-02 | 2.77E-02 | 2.24E-02 | 1.66E-02 | 1.24E-02 |
| 2% PDO in 6 cSt. PAO | 3.38E-01 | 3.46E-02 | 2.75E-02 | 2.10E-02 | 1.64E-02 | 1.51E-02 |
| 2% STO in 6 cSt. PAO | 3.00E-01 | 3.43E-02 | 2.71E-02 | 2.13E-02 | 1.64E-02 | 1.02E-02 |
| 3% 6 cSt. PAO in ESN90 | 6.73E-01 | 5.16E-02 | 4.41E-02 | 3.48E-02 | 2.83E-02 | 2.04E-02 |
| 15% 6 cSt. PAO in ESN90 | 5.73E-01 | 4.93E-02 | 4.21E-02 | 3.33E-02 | 2.72E-02 | 2.00E-02 |

The data in Table 2 indicates that at a 10% treat rate the binary mixtures of ester and base oil resulted in a significantly lower traction (Stribsum) than for either the 3% 6 cSt. PAO in ESN 90 mixture or the 15% 6 cSt. PAO in ESN 90 mixture. Differences between the traction measured for the individual esters were small and varied generally as follows: SMO<PDO<STO. (The lower the traction value, the better the fuel economy performance). At the 2% treat rate, SBO and STO in ESN 90 showed little or no clear advantage over 3% 6 cSt. PAO in ESN 90; the PDO, however, showed a significantly lower traction (Stribsum) than either of the 6 cSt. PAO/ESN 90 mixtures.

Figure 4:
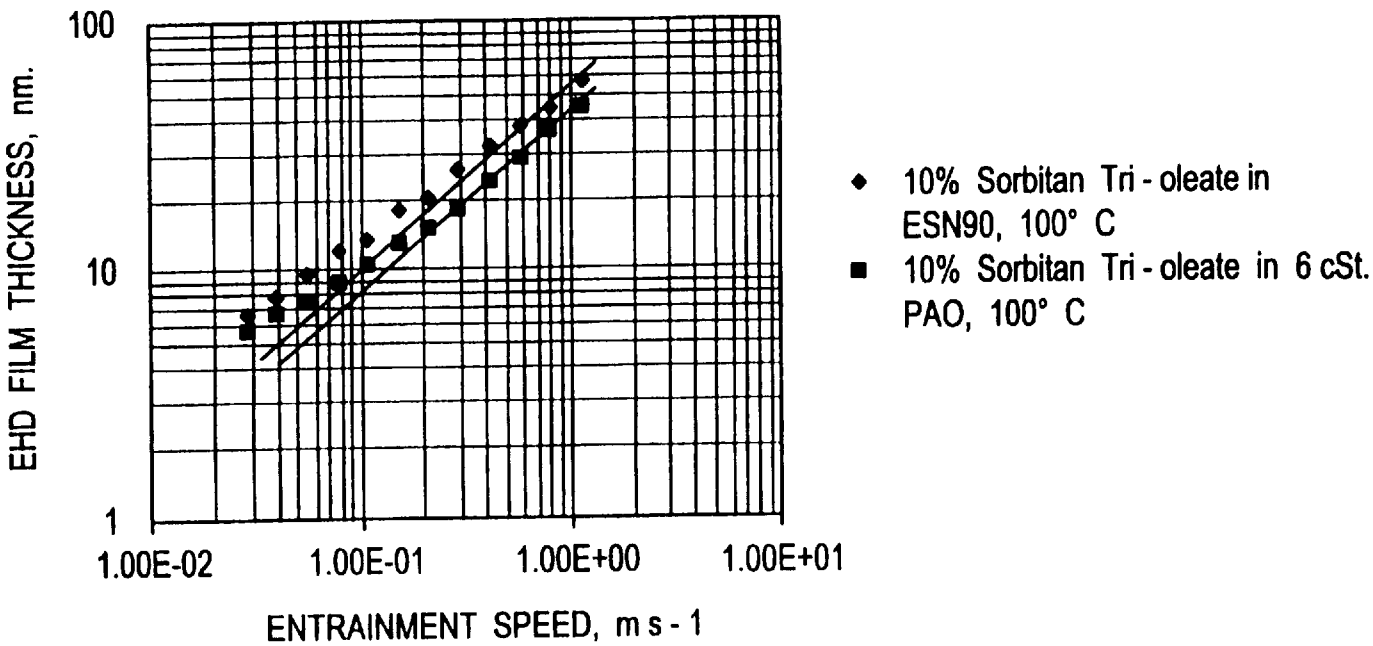
FIG. 4 is a graph, similar to FIG. 3, illustrating the Stribeck curves for a binary mixture of 10% sorbitan trioleate in 6 cSt. PAO and a binary mixture of 10% sorbitan trioleate in ESN 90.

FIG. 4 shows EHD film thickness as a function of entrainment speed at 100° C., for 10% solutions of STO in both ESN 90 and 6 cSt. PAO. The solid lines represent the theoretical lines expected from the bulk viscosities of the test fluids at the contact pressures of the test rig. As seen in the figure, the theoretical film thicknesses are higher for the mineral basestock (ESN 90) than for the PAO basestock because mineral oils have higher pressure coefficients of viscosity than do PAO's. Hence the mineral oils are more viscous at the contact inlet pressures (0.5GPa) than the PAO oils. FIG. 4 also shows that 10% STO in both 6 cSt. PAO (represented by the filled squares) and in ESN 90 (represented by the filled diamonds) resulted in a positive deviation from the theoretical, particularly at lower speeds. This is evidence of surface film formation by the polar ester species which are more viscous than the bulk fluid. Although not shown in FIG. 4, positive deviation from the theoretical was found for all of the ester solutions in Table 2, to differing degrees, at all temperatures tested. At high film thickness, i.e., >30 nm., the system was under hydrodynamic lubrication conditions. Under these conditions the lower traction of the PAO solution is clear. Both test fluids show a substantial positive deviation from the theoretical in the region of 22–25 nm. This represents the transition to the mixed lubrication regime and occurs when the film thickness/surface roughness ratio is approximately 1.5. At very low film thicknesses, i.e., when operating under boundary lubrication conditions, the PAO solution resulted in extremely low traction losses.

Figure 7:
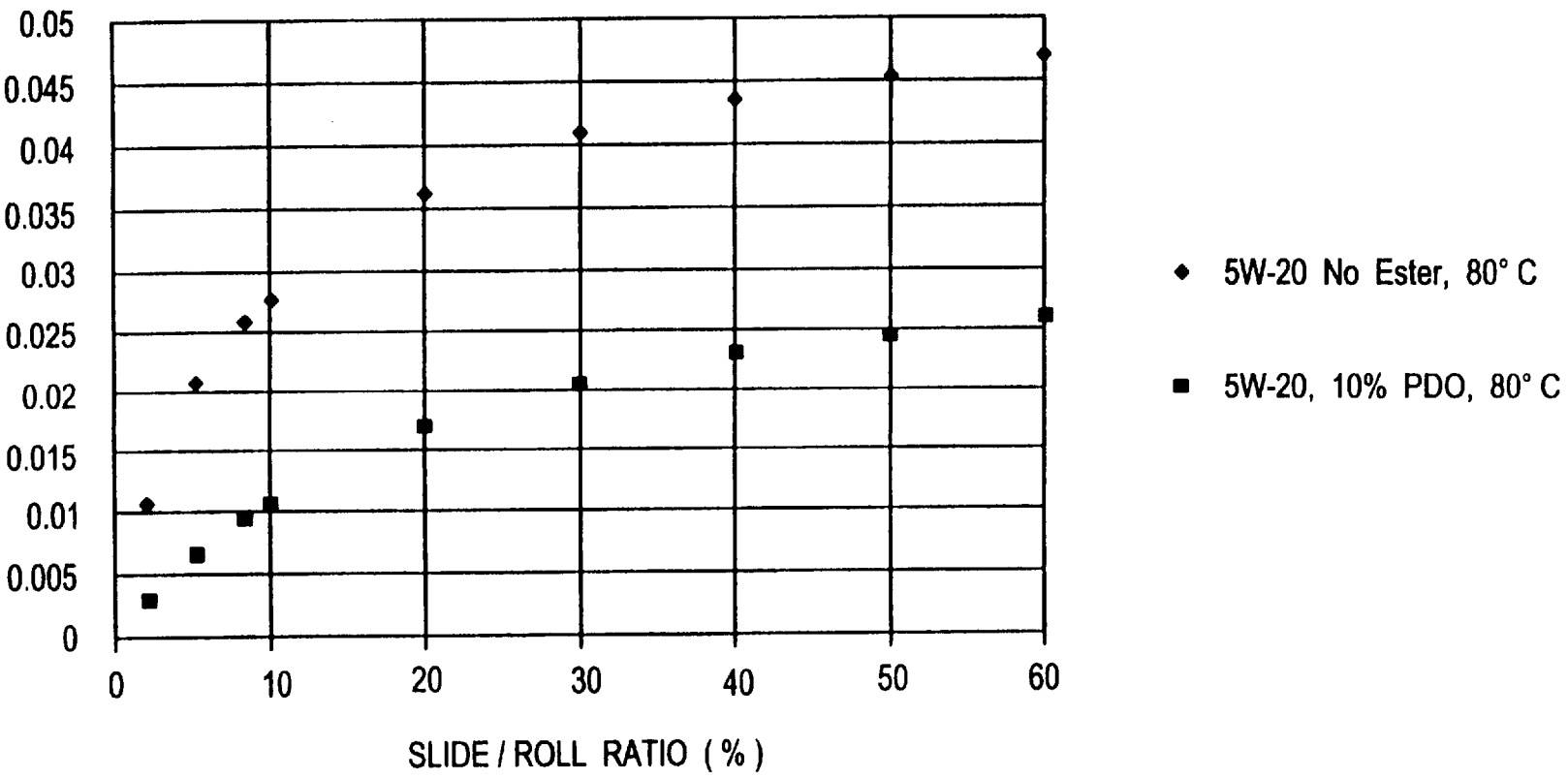
FIG. 7 is a graph illustrating the traction coefficient as a function of slide/roll ratio for a 5W-20 oil formulated with 10 wt. % pentaerythritol diooleate as a fuel economy improving additive and for a 5W-20 oil formulated without any fuel economy improving additive.

FIG. 7 shows the Stribeck Traction curves for a 10% solution of SMO in ESN 90 base oil and for an approximately equiviscous solution of 15% 6 cSt. PAO in the same base oil at 135° C. The frictional advantages for the SMO solution under all conditions can be seen.

Figure 8:
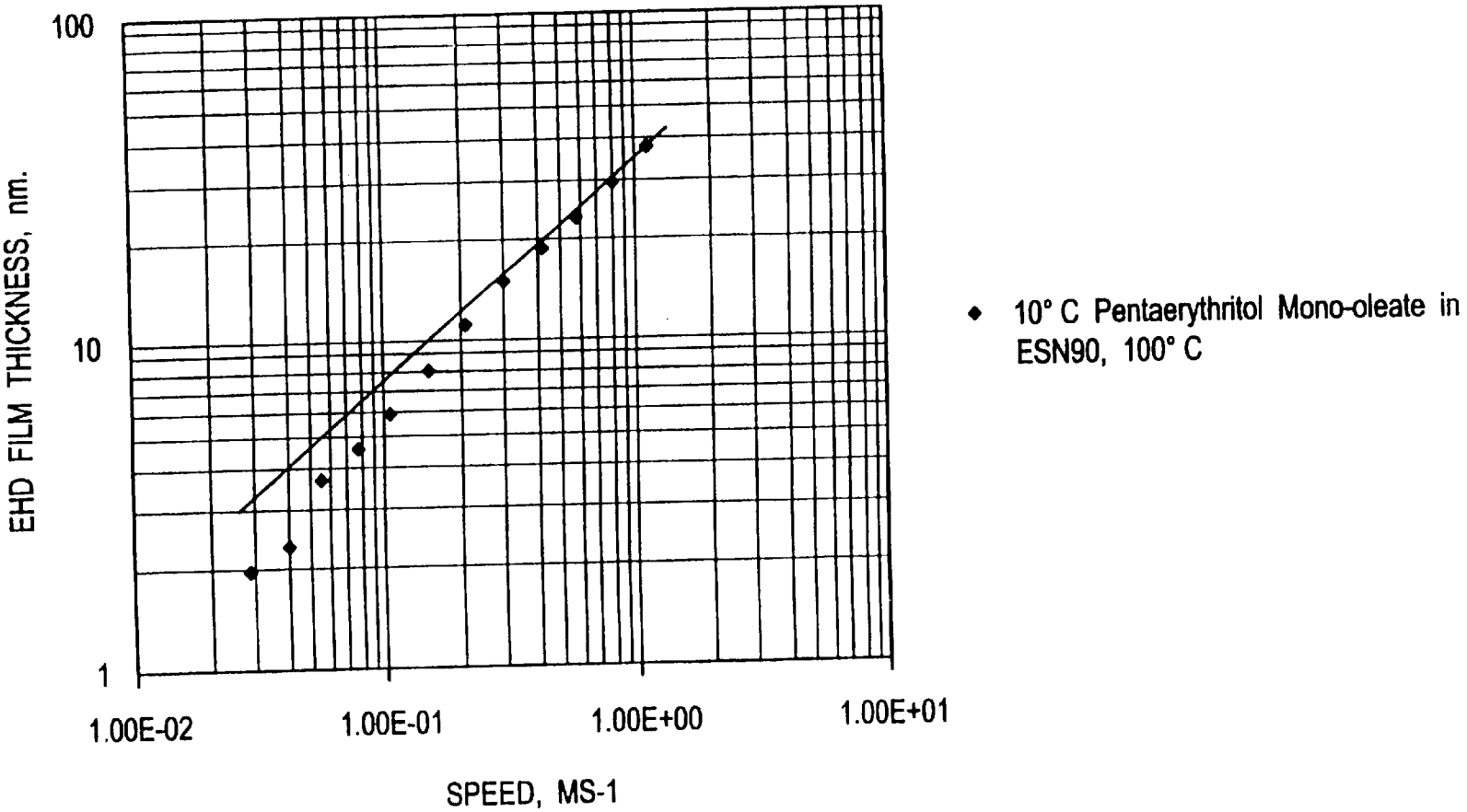
FIG. 8 is a graph, similar to FIG. 3, illustrating the generally neutral or negative deviation relative to a theoretical line of a lubricant composition which is outside the scope of the present invention.

FIG. 8 shows the traction curves as a function of Slide/Roll ratio at 80° C. for a 5W-20 oil which contains no ester fuel economy improving additive and for a 5W-20 oil which contains 10% PDO as a fuel economy improving additive. The frictional advantages for the PDO-containing oil are readily apparent.

EXAMPLE 2

In order to validate the data observed in connection with the binary mixtures tested in Example 1, the procedure of Example 1 was followed using a 5W20 test oil formulated with 10% PDO (5W20-PDO). The composition of the test oil is shown in Tables 3 and 4. For comparison, the test was run again on a second 5W20 oil based upon MTX-5 basestock with PMA as a viscosity index improver, a mixture of primary and secondary zinc dialkyl dithiophosphates, a detergent system based on overbased calcium and magnesium salicylates, and both ashless and molybdenum dithiocarbamate friction modifiers. The comparison oil is shown in Table 4 as 5W20-Mo. The 5W20-Mo test oil was characterized by a 4.9% EFEI in the Sequence VI Screener, a 1.48% EFEI in the Sequence VIA test, a 2.7% EFEI in the M111 Fuel Economy test, and a HTHS and Kv 100 less than that of the 5W20-PDO test oil.

TABLE 3

Addpack Formulation

| COMPONENT | % IN ADDPACK |
|---|---|
| Dispersant | 43.19 |
| Anti-foamant | 0.02 |
| Diluent | 3.5 |
| Overbased detergent | 14.55 |
| Neutral soap | 16.36 |
| Antioxidant | 10.46 |
| Primary ZDDP | 9.09 |
| Secondary ZDDP | 2.27 |
| Demulsifier | 2.27 |
| Friction modifier | 0.46 |

TABLE 4

Oil Formulation

| Test Oil | Addpack | PDO | Basestock | HTHS, cSt. | Kv 100, cSt. |
|---|---|---|---|---|---|
| 5W20-PDO | 11.00% | 10% | 79% | 2.99 | 9.11 |
| 5W20-Mo | — | — | — | 2.55 | 8.81 |

Figure 5:
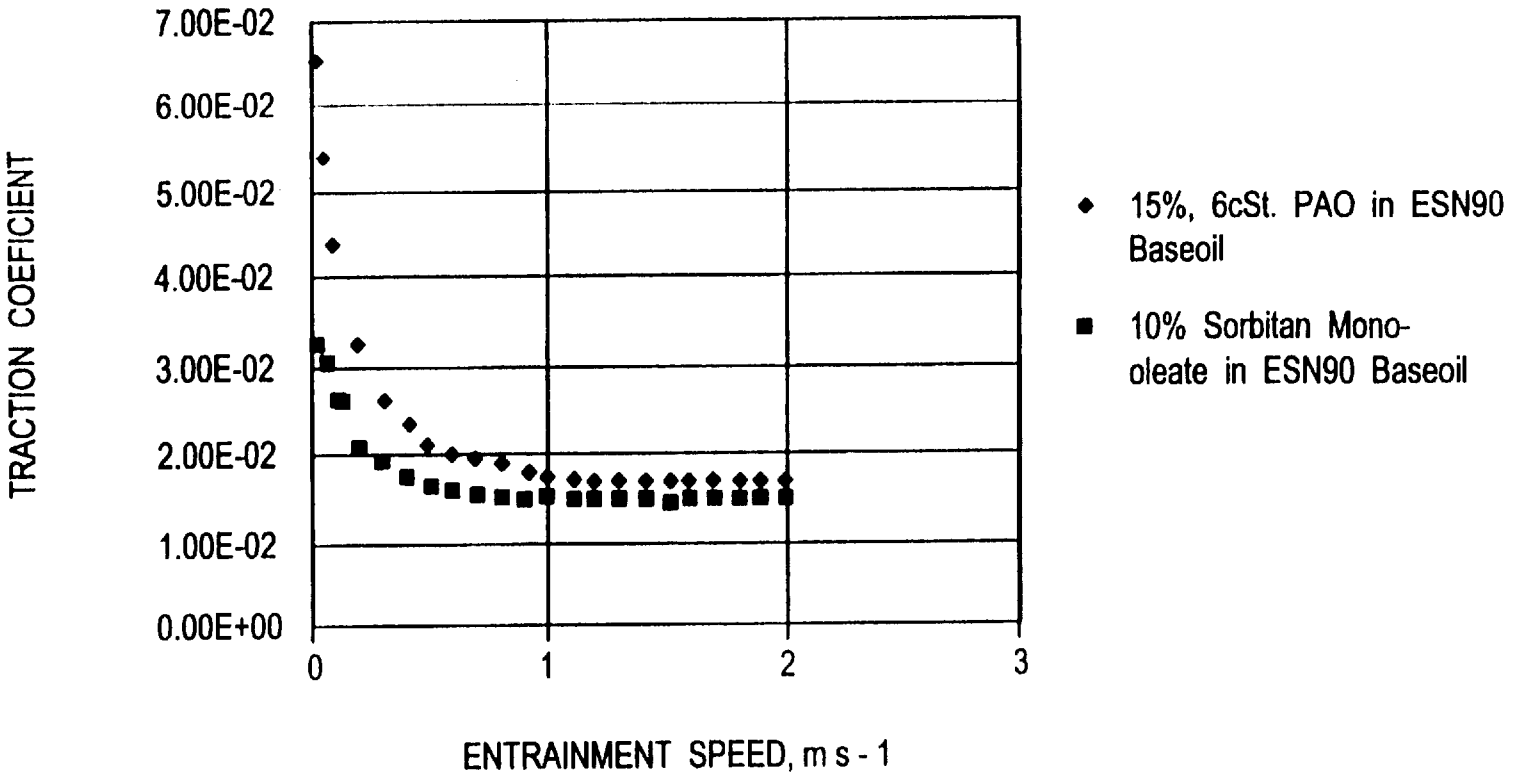
FIG. 5 is a graph illustrating Stribeck traction curves for approximately equiviscous solutions of sorbitan monooleate in ESN 90 base oil and 6 cSt. PAO in ESN 90 base oil.

Traction and film thickness data were generated for 5W20-PDO and 5W20-Mo using the same procedure that was used for the binary mixtures in Example 1. The PDO-containing oil showed thicker film formation, especially at higher temperatures, than did the conventional, Mo-containing 5W20 oil. The PDO-containing oil also showed much lower friction than did the Mo-containing oil. This was true at all temperatures tested. The Stribeck curves for the 5W20-PDO and 5W20-Mo test oils (FIG. 5) clearly show the improved friction performance of the 5W20-PDO test oil.

EXAMPLE 3

Figure 6:
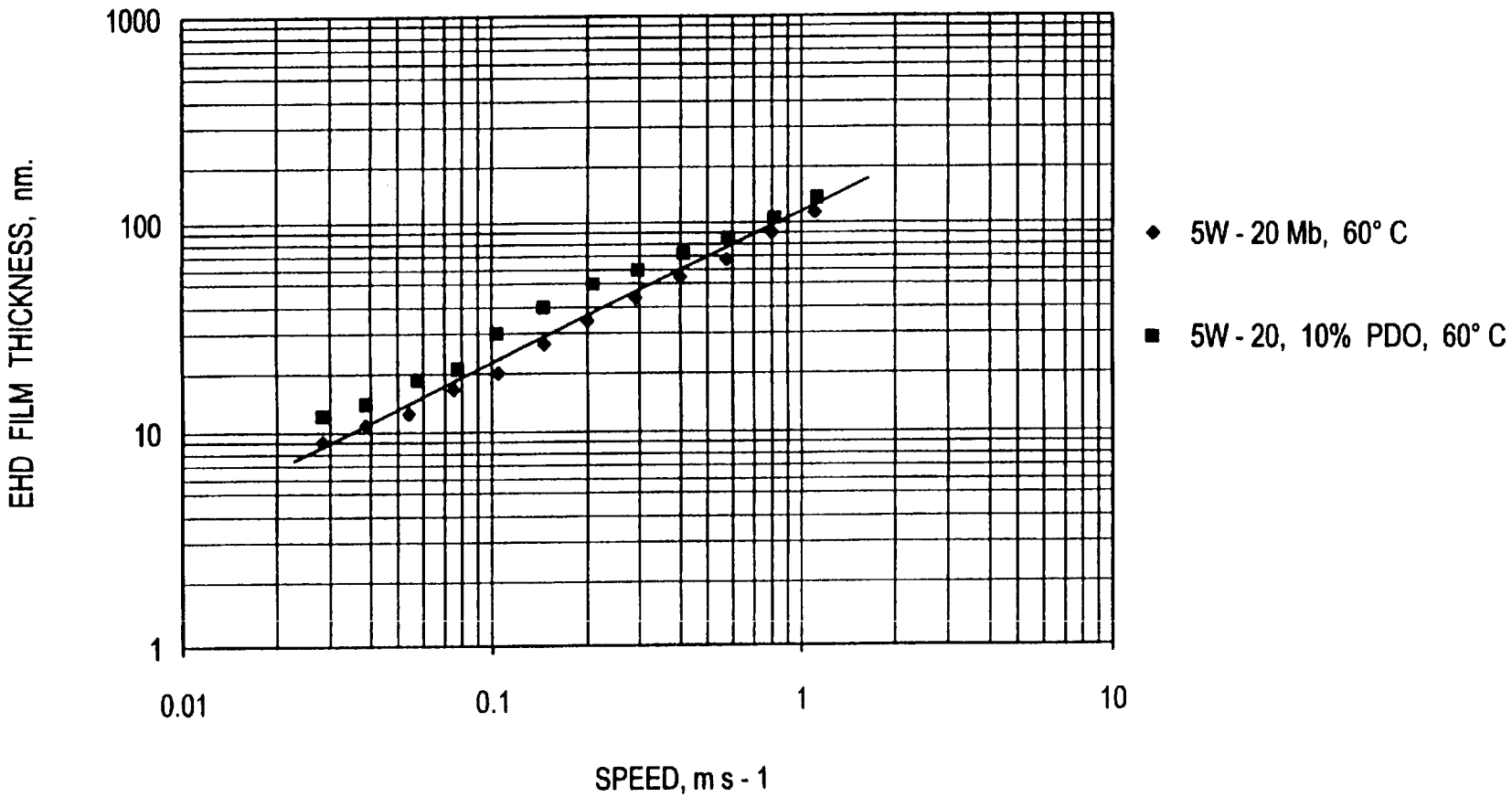
FIG. 6 is a graph, similar to FIG. 4, illustrating the Stribeck curves for a 5W20 oil which contains pentaerythritol dioleate as a fuel economy improving additive and for a comparison 5W20 oil which contains a molybdenum dithiocarbamate friction modifier.

The procedure of Example 1 was repeated for a binary mixture comprising 10% pentaerythritol monooleate (PMO) in ESN 90. FIG. 6 is a Stribeck curve showing the neutral to negative deviation relative to the theoretical that was observed for the 10% PMO solution. That curve clearly indicates PMO is not suitable for use as a fuel economy improving additive in accordance with the present invention.

What is claimed is:

1. A crankcase lubricant composition capable of improving the fuel economy of an internal combustion engine lubricated therewith, which comprises:

a base oil of lubricating viscosity as a major component; and from about 2 to about 50 wt. %, based on the weight of composition, of a fuel economy improving additive; said fuel economy improving additive comprising a polar compound selected from the group consisting of full and partial esters of polyhydric alcohols and unsaturated aliphatic carboxylic acids having from about 9 to about 36 carbon atoms in the carbon chain and having a viscosity greater than the viscosity of said base oil; and said fuel economy improving additive being selected such that the lubricant composition is characterized by (1) a positive deviation from that of a Newtonian fluid when the elastohydrodynamic (EHD) film thickness of the lubricant composition is plotted against entrainment speed on a log basis, and by (2) a traction coefficient under both hydrodynamic and mixed lubricant conditions which is lower than it would have been if said fuel economy improving additive were not present in the lubricant composition.

2. A crankcase lubricant composition according to claim 1, wherein said fuel economy improving additive is present in the composition in an amount of from about 5 to about 15 wt. %.

3. A crankcase lubricant composition according to claim 1, wherein said fuel economy improving additive is present in the composition in an amount of from about 4 to about 25 wt. %.

4. A crankcase lubricant composition according to claim 2 or claim 3, wherein said fuel economy improving additive is selected from the group consisting of full or partial esters of polyhydric alcohols and, unsaturated aliphatic carboxylic acids having from about 10 to about 20 carbon atoms in the carbon chain.

5. A crankcase lubricant composition according to claim 1, wherein said fuel economy improving additive is selected from the group consisting of sorbitan trioleate, sorbitan monooleate and pentaerythritol dioleate and mixtures thereof.

6. A crankcase lubricant composition according to claim 2, wherein said fuel economy improving additive is selected from the group consisting of sorbitan trioleate, sorbitan monooleate and pentaerythritol dioleate and mixtures thereof.

7. A crankcase lubricant composition according to claim 3, wherein said fuel economy improving additive is selected from the group consisting of sorbitan trioleate, sorbitan monooleate and pentaerythritol dioleate and mixtures thereof.

8. A method of improving the fuel economy of an internal combustion engine, which comprises:

adding to the crankcase of an engine to be operated under improved fuel economy conditions, a crankcase lubricant composition comprising a base oil of a lubricating viscosity as a major component, and from about 2 to about 50 wt. %, based on the weight of composition, of a fuel economy improving additive; said fuel economy improving additive comprising a polar compound selected from the group consisting of full and partial esters of polyhydric alcohols and unsaturated aliphatic carboxylic acids having from about 9 to about 36 carbon atoms in the carbon chain and having a viscosity greater than the viscosity of said base oil; and said fuel economy improving additive being selected such that the lubricant composition is characterized by (1) a positive deviation from that of a Newtonian fluid when the elastohydrodynamic (EHD) film thickness of the lubricant composition is plotted against entrainment speed on a log basis, and by (2) a traction coefficient under both hydrodynamic and mixed lubricant conditions which is lower than it would have been if said fuel economy improving additive were not present in the lubricant composition.

9. A method according to claim 8, wherein said fuel economy improving additive is present in the lubricant composition in an amount of from about 5 to about 15 wt. %.

10. A method according to claim 8, wherein said fuel economy improving additive is present in the lubricant composition in an amount of from about 4 to about 25 wt. %.

11. A method according to claim 8, wherein said fuel economy improving additive is selected from the group consisting of full or partial esters of polyhydric alcohols and unsaturated, aliphatic carboxylic acids having from about 9 to about 36 carbon atoms in the carbon chain.

12. A method according to claim 11, wherein said fuel economy improving additive is selected from the group consisting of full or partial esters of polyhydric alcohols and unsaturated, aliphatic carboxylic acids having from about 10 to about 20 carbon atoms in the carbon chain.

13. A method according to claim 8, wherein said fuel economy improving additive is selected from the group consisting of sorbitan trioleate, sorbitan monooleate and pentaerythritol dioleate and mixtures thereof.

14. A method according to claim 9, wherein said fuel economy improving additive is selected from the group consisting of sorbitan trioleate, sorbitan monooleate and pentaerythritol dioleate and mixtures thereof.

15. A method according to claim 10, wherein said fuel economy improving additive is selected from the group consisting of sorbitan trioleate, sorbitan monooleate and pentaerythritol dioleate and mixtures thereof.

* * * * *